United States Patent [19]

Zaniewski

[11] 4,200,035

[45] Apr. 29, 1980

[54] MODULAR VENTILATING ASSEMBLY

[76] Inventor: Michel H. Zaniewski, Avenue Ferdinand de Lesseps, 34110 Frontignan, France

[21] Appl. No.: 869,222

[22] Filed: Jan. 13, 1978

[30] Foreign Application Priority Data

Jan. 14, 1977 [FR] France ..... 77 01647

[51] Int. Cl.[2] ..... F24F 7/06

[52] U.S. Cl. ..... 98/43 R; 98/21; 98/72; 417/424

[58] Field of Search ..... 98/19–21, 98/34, 43 R, 43 B, 43 C, 42 R, 68, 69, 72, 73, 75, 81, 66 R; 417/424; 415/123

[56] References Cited

U.S. PATENT DOCUMENTS

| | | | |
|---|---|---|---|
| 2,582,902 | 1/1952 | Gohl | 98/43 R |
| 2,666,378 | 1/1954 | Ammerman | 98/43 R |
| 2,777,382 | 1/1957 | Solzman | 98/43 R |
| 2,830,526 | 4/1958 | Breidert | 98/81 |
| 2,982,198 | 5/1961 | Mohrman | 98/43 R |
| 3,202,081 | 8/1965 | Cook | 98/43 R |
| 3,739,708 | 6/1973 | Felter | 98/75 |
| 3,797,374 | 3/1974 | Jones | 98/72 |
| 4,015,633 | 4/1977 | Mandell | 417/424 |
| 4,051,770 | 10/1977 | Felter et al. | 98/21 |
| 4,093,397 | 6/1978 | Lovelady | 417/424 |

*Primary Examiner*—Henry C. Yuen
*Attorney, Agent, or Firm*—Karl F. Ross

[57] ABSTRACT

A ventilating assembly is formed of three basic modules, namely a base unit constituted as a static ventilator, a turbine unit constituted as a wind-operated ventilator, and a drive unit which can operate the turbine unit as a motor-driven ventilator. The base unit is affixed to the top of a chimney or a vent stack and can operate all alone as a static ventilator. The turbine can be attached to a seat on this base unit so that the turbine fan lies in a venturi chamber formed between upper and lower portions of the base unit. If desired the motor unit can further be mounted on top of the base unit and the motor output shaft connected to the turbine to drive same.

19 Claims, 8 Drawing Figures

MODULAR VENTILATING ASSEMBLY

FIELD OF THE INVENTION

The present invention relates to a ventilating assembly. More particularly this invention concerns such an assembly usable on a chimney or ventilating stack.

BACKGROUND OF THE INVENTION

It is frequently necessary to augment the convective stack effect to increase the draw in a chimney or the venting of a vent conduit. Static ventilators are known having no moving parts which use ambient wind in a venturi effect to increase the draft. Also known are dynamic or turbine-type ventilators which also use the ambient wind, but to move a turbine or fan that operates as an axial-input radial-output blower to increase the draft. It is also, of course, known to provide a simple motor-driven blower on a stack so as to increase the draft to any desired extent.

All of these above-described devices exist in many different sizes and of constructions that give various venting capacities. It is therefore necessary for the purchaser to determine exactly how much increased venting is needed before buying such a unit. Miscalculation requires replacement of the entire unit with another. The user normally errs on the side of a smaller and cheaper unit, so that any change usually requires scrapping the original purchase and replacing it with a heavier duty device.

OBJECTS OF THE INVENTION

It is therefore an object of the present invention to provide an improved ventilating assembly.

Another object of the provision of such an assembly which can readily be adapted to different situations and which, therefore, is of alterable venting capacity.

Yet another object is to provide such a ventilating assembly whose throughput can easily and readily be increased by even a relatively unskilled handyman.

SUMMARY OF THE INVENTION

These objects are attained according to the present invention in a ventilating assembly comprising three basic parts, namely a base unit constituted as a static ventilator, an intermediate unit constituted as a wind-powered turbine ventilator, and a drive unit. The base unit can be used alone for systems requiring relatively low throughput, the turbine unit can be mounted on it to increase the throughput, or the turbine and the motor can both be added to it to greatly increae the venting capacity.

According to further features of this invention the lower or base unit which is constituted as a static ventilator has no moving parts and is provided with means for securing it fixedly on top of a chimney or vent conduit. The lower portion of this base unit is formed as an upwardly tapered frustoconical ring. An upper portion spaced above the lower portion may also be formed as a frustoconical ring, but of larger diameter and tapered downwardly so as to form with the lower portion a venturi chamber. Thus ambient air blowing through the base unit between the upper and lower portions thereof will suck gas through the lower portion and hence out of the stack or conduit on which it is mounted.

The upper portion of the base unit is provided with the seat on which can be secured the mounting portion of the wind-powerable turbine unit. This last-mentioned unit comprises an axial-input radial-output fan mounted via a bearing so that when the wind blows past the unit the fan will rotate and suck gas up through the lower portion of the base unit.

Finally the venting capacity of this system can be increased even further by mounting the motor unit on top of the base unit and turbine unit. This motor unit has a mounting portion which is also securable to the seat of the base unit and is provided with a motor whose output shaft can be connected via a coupling to the fan. Thus this motor can drive the fan and, even in the absence of any ambient wind, operate the fan to positively suck gas up out of the chimney through the lower portion and expel it radially outwardly, squirrel-cage fashion. This drive unit has a bonnet which completely covers and protects the motor from the elements. Insulation is provided between the motor unit and the base unit to protect the motor of the drive unit from the relatively high temperatures of the base unit and turbine when the device is used to increase the draw through a chimney connected to a fireplace, furnace, or the like. Thus the motor may be mounted on insulating spacers and an air gap may be provided between the hood surrounding the motor and the base part so that the motor is ventilated.

SPECIFIC DESCRIPTION

Figure 6:
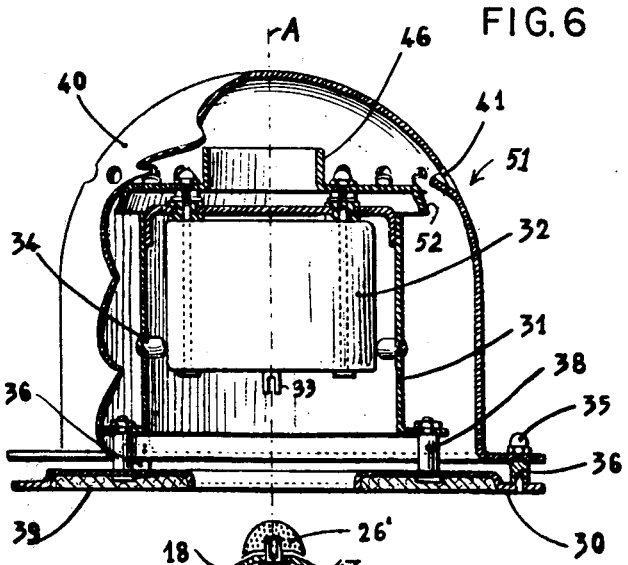
FIG. 6 is a partly sectional side view of the motor unit according to this invention.

The ventilator assembly according to this invention basically comprises a base unit 48 securable over the upper end of an exhaust stack or chimney 49, an intermediate wind-powerable turbine unit 50, and an upper drive unit 51. The units 48, 50 and 51 are respectively seen in FIGS. 1, 4, and 6, and FIG. 8 shows the three units all mounted together.

The base part 48 basically comprises an upwardly tapering lower frustoconical ring 1 and a downwardly tapering upper frustoconical ring 8 centered on and spaced apart on an axis A. The lower ring 1 is provided around its lower periphery with three angularly equispaced U-shaped clips 3 each formed with a pair of throughgoing holes one of which is threaded. The two holes of each clip 3 receive a respective radially extending screw 2 having a pointed inner end 4. Thus it is possible to mount the base unit 48 securely on a chimney 49 by positioning the lower ring 1 over the chimney 49 and then equally screwing in the three screws 2 to drive the sharpened points 4 into the chimney. Even if the chimney is of tile or ceramic material the sharpened points 4 will be able to penetrate sufficiently to securely hold the lower unit 48 on the chimney 49. Furthermore the relatively small diameter of the pointed tips 4 will insure that if excessive force is applied to them that they will break off rather than shatter the chimney top.

Extending upwardly from each of the U-shaped brackets 3 to a generally circular plate 6 is a spacer rod 5 parallel to the axis A. The outer periphery of the disk 6 is secured at each of the spacer rods 5 by means of a L-shaped bracket 7 to the upper region of the upper frustoconical ring 8. The diameter d of the upper end of the lower ring 1 is smaller than the diameter d' of the lower periphery of the upper ring 8. Furthermore the lower diameter D of the lower ring 1 is greater than the diameter d' but smaller than the diameter D' of the upper end of the ring 8. Finally the diameter D'' of the outer periphery of the disk 6 is slightly larger than the diameter d' but smaller than the diameter D so that an annular space is left between the outer periphery of the disk 8 and the upper end of the ring 8 except where the brackets 7 are provided.

The lower frustoconical ring 1 is formed adjacent its lower periphery with grooves of relatively large radius of curvature and adjacent its upper smaller periphery with grooves of smaller radius of curvature to enhance the venturi effect. The lower ends of the space rods 8 are permanently secured to the ring 1 at the brackets 3 and the upper ends have threaded extensions over which may be mounted nuts 35 to hold the upper ring 8 in place.

At its center the disk 6 has a central hole 9 at the axis A and a plurality of offset holes 10 spaced about the axis A. A removable throwaway cover 26 normally overlies the raised central portion of the disk 6 to block the holes 9 and 10 when the unit 48 is used alone.

When the unit 48 is mounted on the top of the chimney 49 it prevents water from falling into the chimney 49 due to the relative diameters of two frustoconical rings 1 and 8. Furthermore the shape of the lower ring 1 in combination with the upper ring 8 makes a venturi effect so that as ambient air blows horizontally and through the unit 48 it sucks or aspirates gas out of the chimney 49. Thus the lower unit 48 constitutes a static ventilator 48 having no moving parts but which nonetheless enhances aspiration of air from a chimney 49 on which it is mounted.

Figure 2:
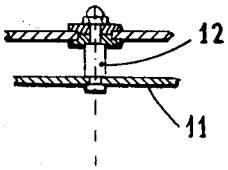
FIG. 2 is a large-scale sectional view of a detail of an alternative mounting arrangement for the assembly according to this invention.

It is also possible as shown in FIG. 2 to replace the upper frustoconical ring 8 with a planar circular disk 11 secured by means of spacer screws 12 to the disk 6. This plate 11 will have a diameter equal to or slightly superior to the diameter d.

Figure 3:
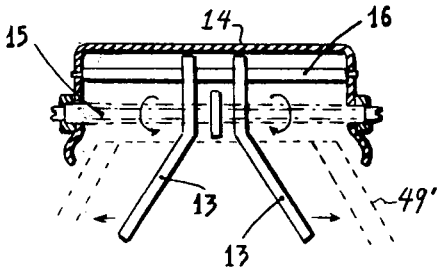
FIG. 3 is a section through a mounting arrangement for the assembly according to this invention.

Furthermore as shown in FIG. 3 it is possible to mount the lower portion 1 of the unit 48 on a chimney, in particular a glazed tile chimney 49' such as shown in FIG. 3 having an upward taper. Thus a U-shaped clip 14 is fitted into the lower cone 11 and secured therein. This clip 14 carries an upper diametrical guide rod 16 and lower counterscrew 15. A pair of opposite outwardly directed claws 13 are engaged on the screw 15 and when it is rotated in one direction these claws 13 move toward each other and when rotated in the opposite direction they move away from each other. The rod 16 also extends through both of the claws 13 to maintain them in the desired vertical orientation.

Figure 4:
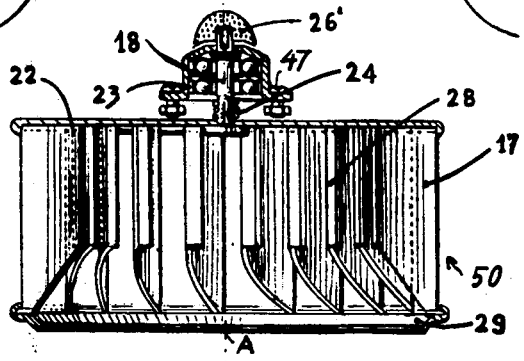
FIG. 4 is a side partly sectional view of the wind-powered fan unit according to the instant invention.
Figure 1:
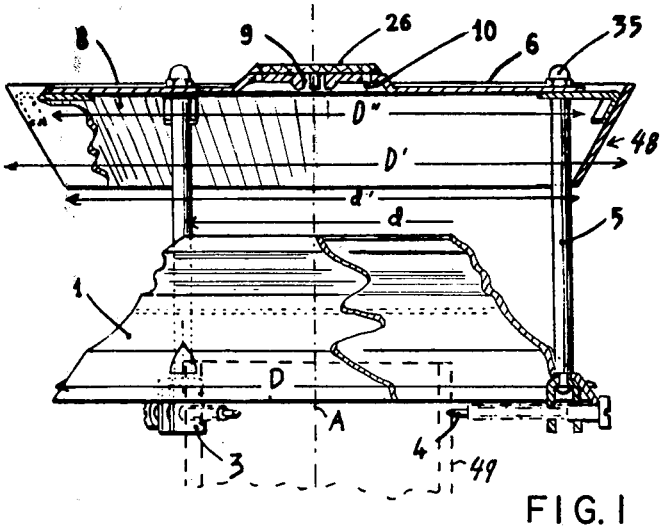
FIG. 1 is a side partly sectional view of the base unit of the ventilator system according to this invention.
Figure 5:
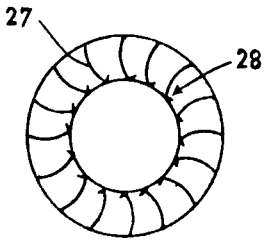
FIG. 5 is a small-scale largely schematic top view showing the fan according to this invention.
Figure 8:
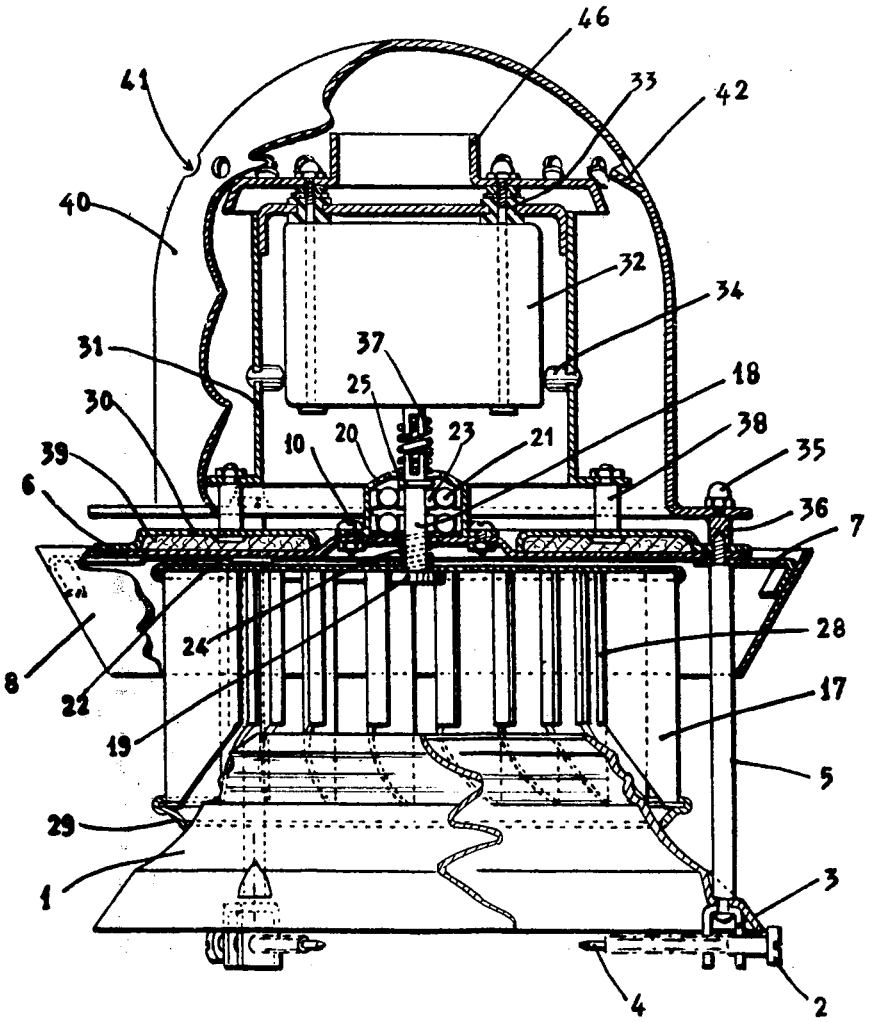
FIG. 8 is side partly sectional view of the complete assembly according to the invention.

The intermediate unit 50 shown in FIG. 4 is added to the base unit 48 in order to increase the ventilating capacity of the system. This unit 50 basically comprises a wind-powerable fan 17 having an upper plate 22, a lower annular plate 29, and vanes 27. As shown in FIG. 5 the vanes 27 are curved and bent over at 28 at their radially inner ends. These vanes 27 are formed as portions of a parabola whose generatrix is parallel to the axis A of the turbine unit. The inner edges 28 are bent over toward the concave side of the parabolic section. In addition the lower portions of the vanes 27 are cut away so that this fan 17 can fit closely over the frustoconical ring 1.

The fan 17 hangs on a shoulder 19 formed on the lower end of a shaft 18. This shaft 18 in turn is carried in inner races 23 of bearings 21 whose outer races are held in a cage 20 which may be secured by screws 47 through the holes 10 to the seat constituted by the plate 6. Prior to such mounting, of course, the temporary protective cover 26 is removed. A compression spring 24 surrounds the shaft 18 and bears at its upper end on the inner race 23 of the lower bearing 21 and at its lower end on the upper plate 22 of the fan 17 so as to press it against the shoulder 19 and frictionally couple the fan 17 and shaft 18 together. This shaft 18 is also formed with a groove in which is engaged a snap ring 25 that engages downwardly against the race 23 of the upper bearing 21 to hold the entire assembly snugly together. The turbine unit 50 is delivered with a cap 26' of elastomeric material force-fitted over the cleft upper end of the shaft 18.

When the turbine unit 50 is mounted on the static ventilating unit 38 the ventilating capacity of the assembly is considerably increased. As horizontally blowing wind rotates the fan 17 it will inherently draw the gas out of the interior up through the lower portion 1. This squirrel-cage fan 17 is effective no matter which quarter the wind comes from so as to increase the venting capacity of the assembly. Furthermore the provision of this fan 17 in the venturi chamber formed between the upper and lower portions of the unit 48 ensures that it is almost impossible for ambient air to blow down into the chimney 49 over which the assembly 48, 50 is mounted.

If the venting capacity still needs to be increased it is then possible to mount the drive unit 51 on top of the assembly 48, 50. This unit 51 has an annular base disk 30 on which is supported an upwardly extending collar or sleeve 31 by means of insulating spacers 38. A motor 32 is supported on grommets on a bracket across the upper end of the sleeve 31 and has a downwardly projecting cleft output shaft 33 that lies on the axis A. The disk 30 has a central aperture and an asbestos ring 39 that is adapted to lie flatly on the disk 6. Bumpers 34 in the sleeve 31 center the motor 32 but still allow limited motion of this motor 32 relative to the sleeve 31.

In order to mount the unit 51 on the units 48 and 50 the removable cover 26' is pulled off the upper end of the shaft 18. The nuts 35 that hold the plate 6 on the upper ends of the spacers 5 are then removed and the threaded upper ends of these spacers 5 are fitted to corresponding holes in the outer periphery of the disk 30. Thereafter spacer studs 36 are screwed over the upper ends of the spacers 5 to lock the disk 30 tightly in place on the disk 6.

A torque-transmitting spring 37 is engaged between the facing cleft ends of the shafts 33 and 18. This spring 37 not only rotationally couples the two shafts 18 and 33 together, but acts as a universal joint to compensate for minor misalignment of the two, and at the same times inhibits transmission of heat upwardly to the motor 32 through the shaft 33.

Thereafter a downwardly cup-shaped covering bonnet 40 is fitted over the upper male ends of the studs 36 and the nuts 35 are secured over the studs 36 to lock the bonnet 40 tightly in place. This bonnet 40 is formed with holes 41 that are constituted by bent-in tongues 42 that prevent rain from entering the unit. In addition a disk 52 is secured over the top of the sleeve 31 and has an upwardly extending collar 46 so that should any moisture blow in it will absolutely be unable to fall on the motor 32, but instead will drain down outside the cover 31 and thence out through the vertical space between the flanges of the disk 30 and the bonnet 40.

The entire motor assembly is therefore well insulated from the lower units 48 and 50 by means of the asbestos disk 39, the insulating spacers 38, the spring 37, and the free-air space between the bonnet 40 and ring 30.

Figure 7:
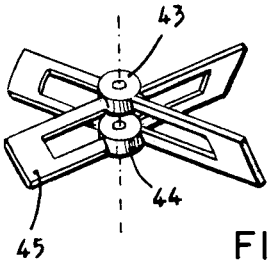
FIG. 7 is a perspective view of a coupling usable in the assembly according to this invention.

It is possible to further insure lower motor operating temperature by replacing the spring 37 with a coupling such as shown in FIG. 7 which has an upper ring 43 secured by means of a set screw to the shaft 33 and a lower ring 44 similarly secured by a set screw to the shaft 18. Flexible U-shaped vanes 35 connect these rings 43 and 44 with one leg of each vane connected to one of the rings 43 and 44. These vanes are tipped relative to the normal direction of rotation of the motor 32 so as to draw air in through the space between the bonnet 40 and the disk 30 and force it upwardly through the motor 32, eventually venting through the holes 41.

With the system according to the instant invention it is therefore possible to increase the venting capacity to any desired extent. The user need merely buy a static ventilating unit 48 if that will be sufficient. At any later date it is possible in a very simple manner to add the dynamic unit 50, merely by removing the nuts 35 and mounting the unit 50 by means of the screws 47 on the disk 6. Thereafter it is further possible again to increase the capacity of the unit by mounting a motor unit 51 on top of it and wiring it to an appropriate source of electrical power. The motor 32 can be operated by a thermostat switch in the chimney 49 or other automatic control circuitry. Thus it is possible to obtain three different venting capacities with a completely integrated unit that can be marketed and sold as separate modules. The user need not be highly skilled in order to mount these devices on a chimney or the like, or to increase or decrease the capacity of them.

It would also be possible to provide a one-way clutch between the shafts 18 and 33 so that if the motor 32 is not energized it will not impede rotation of the fan 17.

I claim:

1. A ventilating assembly comprising:

a base unit constituted as a static ventilator centered on a base-unit axis and having a lower portion fittable over a conduit to be vented, means for fixing said lower portion to sait conduit, and an upper portion forming a pair of concentric inner and outer seats, spaced axially above said lower portion, and formed at said base-unit axis with an axially throughgoing hole;

a cover releasably securable to said upper portion over said hole thereof;

a turbine unit constituted as a wind-powerable ventilator and having a mounting portion securable to said upper portion at said inner seat, a wind-powerable fan rotatable about said turbine axis and having a fan shaft extending upwardly therealong and through said hole when said mounting portion is secured to said inner seat, and means for mounting said fan on said mounting portion for rotation by ambient wind for aspirating gas through said lower portion from said conduit; and a drive unit having a mounting portion securable to said outer seat, a motor having an output, a coupling engageable between said output and said fan shaft when same is extending upwardly through said hole, whereby said motor can drive said fan, and means for releasably connecting said mounting portion of said drive unit to said outer seat.

2. The assembly defined in claim 1 wherein said means for fixing includes at least one horizontally extending screw on said lower portion engageable in said conduit.

3. The assembly defined in claim 1 wherein said means for fixing includes a pair of claws and a compound screw engaging said claws and secured to said lower portion.

4. The assembly defined in claim 1, further comprising a cap releasably secured to said shaft above the mounting portion of said turbine unit and normally preventing water from entering said hole when said turbine unit is secured to said base unit.

5. The assembly defined in claim 1 wherein said base unit has spacers holding said upper portion above said lower portion, said upper and lower portions defining a venturi chamber.

6. The assembly defined in claim 5 wherein said fan lies in said chamber when the respective mounting portion is secured to the respective seat.

7. The assembly defined in claim 5 wherein said lower portion is formed as an upwardly tapered frustoconical ring.

8. The assembly defined in claim 7 wherein said upper portion has a predetermined diameter, said lower portion having a diameter at its upper small end smaller than said predetermined diameter.

9. The assembly defined in claim 8 wherein said upper portion is a flat generally planar and circular disk.

10. The assembly defined in claim 8 wherein said upper portion is a downwardly tapered frustoconical ring.

11. The assembly defined in claim 10 wherein said predetermined diameter is the diameter of said upper portion at its lower smaller end.

12. The assembly defined in claim 10 wherein said lower portion is annular and centered on said unit axis, said means for fixing including a plurality of such screws extending radially and angularly spaced about said unit axis.

13. The assembly defined in claim 6 wherein said fan is constituted as an axial-input radial output fan.

14. The assembly defined in claim 13 wherein said fan has arcuate vanes having radially inner ends bent over toward the concave side of respective vane.

15. The assembly defined in claim 14 wherein said shaft has a shoulder and said turbine unit includes a spring pressing said fan against said shoulder.

16. The assembly defined in claim 13 wherein said coupling is a spring engageable between said shaft and said output of said motor.

17. The assembly defined in claim 13 wherein said coupling includes a small axial-throughput fan connectable to said shaft and to said output of said motor.

18. The assembly defined in claim 13 wherein said motor is an electric motor.

19. The assembly defined in claim 13, further comprising insulation between said motor and said mounting portion of said drive unit.

* * * * *